US007690889B2

(12) United States Patent
Giaimo et al.

(10) Patent No.: US 7,690,889 B2
(45) Date of Patent: Apr. 6, 2010

(54) INNER DIAMETER VARIABLE VANE ACTUATION MECHANISM

(75) Inventors: John A. Giaimo, Weston, FL (US); John P. Tirone, III, Moodus, CT (US)

(73) Assignee: United Technologies Corporation, Hartford, CT (US)

( * ) Notice: Subject to any disclaimer, the term of this patent is extended or adjusted under 35 U.S.C. 154(b) by 767 days.

(21) Appl. No.: 11/185,995

(22) Filed: Jul. 20, 2005

(65) Prior Publication Data

US 2007/0020094 A1 Jan. 25, 2007

(51) Int. Cl.
*F01D 17/16* (2006.01)

(52) U.S. Cl. ..... 415/160

(58) Field of Classification Search ..... 415/149.4, 415/150, 159–166
See application file for complete search history.

(56) References Cited

U.S. PATENT DOCUMENTS

| | | | | | |
|---|---|---|---|---|---|
| 2,233,983 | A * | 3/1941 | Kice, Jr. | 415/160 |
| 2,805,818 | A * | 9/1957 | Ferri | 415/148 |
| 2,917,275 | A * | 12/1959 | Magin | 415/105 |
| 2,933,234 | A * | 4/1960 | Neumann | 415/149.4 |
| 2,994,509 | A * | 8/1961 | Walker | 415/159 |
| 3,025,036 | A * | 3/1962 | Kumm et al. | 415/23 |
| 3,113,430 | A * | 12/1963 | Beale et al. | 60/796 |
| 3,314,654 | A * | 4/1967 | Thenault et al. | 415/160 |
| 3,352,537 | A * | 11/1967 | Petrie | 60/39.01 |
| 3,632,224 | A * | 1/1972 | Wright et al. | 415/149.4 |
| 3,685,920 | A * | 8/1972 | Burge | 415/149.4 |
| 3,816,021 | A * | 6/1974 | Lewis et al. | 415/147 |
| 3,836,327 | A * | 9/1974 | Bartsch | 8/593 |
| 4,044,815 | A | 8/1977 | Smashey et al. | |
| 4,792,277 | A * | 12/1988 | Dittberner et al. | 415/160 |
| 4,812,106 | A * | 3/1989 | Purgavie | 415/139 |
| 4,834,613 | A | 5/1989 | Hansen et al. | |
| 4,990,056 | A * | 2/1991 | McClain et al. | 415/160 |
| 5,024,580 | A | 6/1991 | Olive | |
| 5,039,277 | A | 8/1991 | Naudet | |
| 5,328,327 | A * | 7/1994 | Naudet | 415/160 |
| 5,380,152 | A * | 1/1995 | Sikorski et al. | 415/160 |
| 5,387,080 | A * | 2/1995 | Bouhennicha et al. | 415/150 |
| 5,601,401 | A * | 2/1997 | Matheny et al. | 415/160 |
| 5,630,701 | A * | 5/1997 | Lawer | 415/160 |
| 6,283,705 | B1 | 9/2001 | Rice et al. | |
| 6,321,449 | B2 | 11/2001 | Zhao et al. | |
| 6,413,043 | B1 | 7/2002 | Bouyer | |
| 6,688,846 | B2 * | 2/2004 | Caubet et al. | 415/160 |
| 6,790,000 | B2 * | 9/2004 | Wolf | 415/165 |
| 6,799,945 | B2 * | 10/2004 | Chatel et al. | 415/156 |
| 6,843,638 | B2 | 1/2005 | Hidalgo et al. | |
| 7,104,754 | B2 * | 9/2006 | Willshee et al. | 415/159 |

* cited by examiner

*Primary Examiner*—Christopher Verdier
(74) *Attorney, Agent, or Firm*—Kinney & Lange, P.A.

(57) ABSTRACT

A variable vane actuation mechanism is comprised of a first drive vane arm and a second drive vane arm for driving a first variable vane array and a second variable vane array, respectively, of a stator vane section of a gas turbine engine. The first drive vane arm and second drive vane arm are connected to each other at a first end by a linkage. The first drive vane arm and second drive vane arm are connected at a second end to a first drive vane and a second drive vane, respectively, of the first and second variable vane arrays. The first drive vane arm and second drive vane arm respond in unison to a single actuation source connected to one of the first drive vane arm and second drive vane arm.

19 Claims, 6 Drawing Sheets

INNER DIAMETER VARIABLE VANE ACTUATION MECHANISM

This invention was made with U.S. Government support under contract number N00019-02-C-3003 awarded by the United States Navy, and the U.S. Government may have certain rights in the invention.

CROSS-REFERENCE TO RELATED APPLICATION(S)

The present application is related to the following copending applications filed on the same day as this application: "RACK AND PINION VARIABLE VANE SYNCHRONIZING MECHANISM FOR INNER DIAMETER VANE SHROUD" by inventors J. Giaimo and J. Tirone III (Ser. No. 11/185,622); "SYNCH RING VARIABLE VANE SYNCHRONIZING MECHANISM FOR INNER DIAMETER VANE SHROUD" by inventors J. Giaimo and J. Tirone III (Ser. No. 11/185,623); "GEAR TRAIN VARIABLE VANE SYNCHRONIZING MECHANISM FOR INNER DIAMETER VANE SHROUD" by inventors J. Giaimo and J. Tirone III (Ser. No. 11/185,624); "LIGHTWEIGHT CAST INNER DIAMETER VANE SHROUD FOR VARIABLE STATOR VANES" by inventors J. Giaimo and J. Tirone III (Ser. No. 11/185,956). All of these applications are incorporated herein by this reference.

BACKGROUND OF THE INVENTION

This invention relates generally to gas turbine engines and more particularly to variable stator vane assemblies for use in such engines.

Gas turbine engines operate by combusting a fuel source in compressed air to create heated gases with increased pressure and density. The heated gases are ultimately forced through an exhaust nozzle, which is used to step up the velocity of the exiting gases and in-turn produce thrust for driving an aircraft. The heated air is also used to drive a turbine for rotating a fan to provide air to a compressor section of the gas turbine engine. Additionally, the heated gases are used for driving rotor blades inside the compressor section, which provides the compressed air used during combustion. The compressor section of a gas turbine engine typically comprises a series of rotor blade and stator vane stages. At each stage, rotating blades push air past the stationary vanes. Each rotor/stator stage increases the pressure and density of the air. Stators serve two purposes: they convert the kinetic energy of the air into pressure, and they redirect the trajectory of the air coming off the rotors for flow into the next compressor stage.

The speed range of an aircraft powered by a gas turbine engine is directly related to the level of air pressure generated in the compressor section. For different aircraft speeds, the velocity of the airflow through the gas turbine engine varies. Thus, the incidence of the air onto rotor blades of subsequent compressor stages differs at different aircraft speeds. One way of achieving more efficient performance of the gas turbine engine over the entire speed range, especially at high speed/high pressure ranges, is to use variable stator vanes which can optimize the incidence of the airflow onto subsequent compressor stage rotors.

Variable stator vanes are typically circumferentially arranged between an outer diameter fan case and an inner diameter vane shroud. A synchronizing mechanism simultaneously rotates the individual stator vanes in response to an external actuation source.

In some situations, it is advantageous to divide the compressor section into upper and lower halves to expedite maintenance of the gas turbine engine. It is particularly advantageous, for example, in military applications when maintenance must be performed in remote locations where complete disassembly is imprudent. However, in dividing the compressor section into halves, the synchronizing mechanism must also be split apart. This creates two synchronizing mechanisms that must be actuated in unison to orchestrate simultaneous operation of all of the stator vanes. Synchronizing mechanisms that are located on the outer case can be accessed and spliced together easily. However, this is not the case for inner diameter synchronizing mechanisms, which cannot be accessed after assembly to attach the synchronizing mechanisms together. Thus, there is a need for an apparatus for coordinating actuation of split inner diameter synchronizing mechanisms.

BRIEF SUMMARY OF THE INVENTION

The present invention comprises a first drive vane arm and a second drive vane arm for driving a first variable vane array and a second variable vane array, respectively, of a stator vane section of a gas turbine engine. The first drive vane arm and second drive vane arm are connected to each other at a first end by a linkage. The first drive vane arm and second drive vane arm are connected at a second end to a first drive vane and a second drive vane, respectively, of the first and second variable vane arrays. The first drive vane arm and second drive vane arm respond in unison to a single actuation source connected to one of the first drive vane arm and second drive vane arm.

DETAILED DESCRIPTION

Figure 1B:
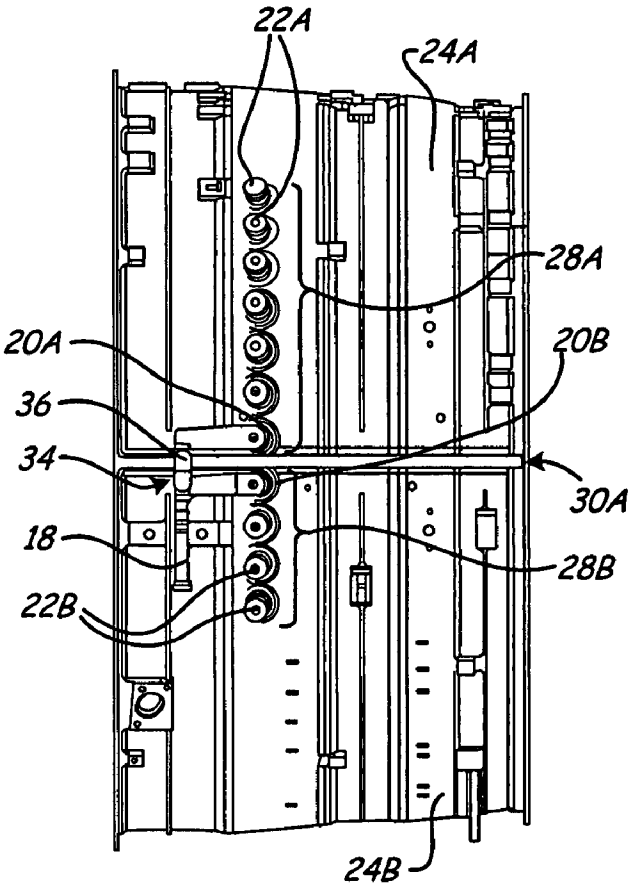
FIG. 1B shows a side view of a stator vane section of a gas turbine engine in which the present invention is used.
Figure 1A:
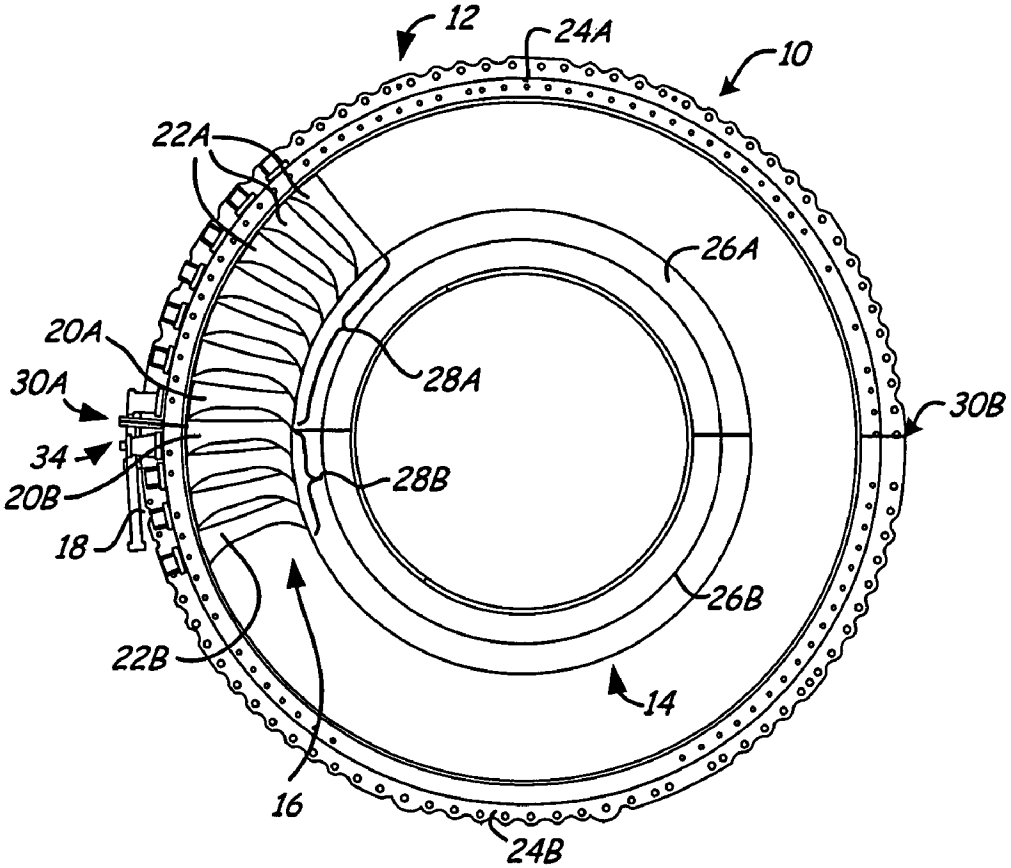
FIG. 1A shows a back view of a stator vane section of a gas turbine engine in which the present invention is used.

FIG. 1A shows a back view of stator vane section 10 of a gas turbine engine in which the present invention is used. Stator vane section 10 comprises fan case 12, vane shroud 14, variable stator vane array 16 and actuator 18. Stator vane array 16 is comprised of drive vanes 20A and 20B follower vanes 22A and 22B. Typically, follower vanes 28 encircle the entirety of vane shroud 14. For clarity, only a portion of variable stator vane array 16 is shown. Drive vanes 20 and follower vanes rotate about their axis in fan case 12 and inner diameter vane shroud 14. Drive vanes 20A and 20B are connected directly with actuator 18 at their outer diameter end. Drive vanes 20A and 20B are connected inside vane shroud 14 by a variable vane synchronizing mechanism such as described in the copending related applications referred to above and summarized below with respect to FIGS. 4A-6. Thus, when actuator 18 rotates drive vanes 20A and 20B, follower vanes 22A and 22B rotate a like amount.

Stator vane section 10 is divided into first and second sub-assemblies. Fan case 12 is comprised of a first fan case component 24A and second fan case component 24B. Vane shroud 14 is similarly comprised of first vane shroud component 26A and second vane shroud component 26B. Stator vane array 16 is also comprised of a first array component 28A and second array component 28B. In one embodiment, the fan case components, the vane shroud components and the vane array components comprise upper and lower assemblies for use in a split fan configuration. The first and second sub-assemblies come together at first split line 30A and second split line 30B. First array component 28A and second array component 28B operate independently from one another. The synchronizing mechanism contained within vane shroud 14 does not synchronize the rotation of the first array component 28A and second array component 28B because of the discontinuity caused by first split line 30A and second split line 30.

FIG. 1B shows a side view of stator vane section 10 of a gas turbine engine in which the present invention is used. First fan case component 24A and second fan case component 24B come together at split line 30A. First fan case component 24A includes first array component 28A. Second fan case portion 24B includes second vane array 28B. First array component 28A and second array component 28B are independently synchronized with respective internal synchronizing mechanisms. Actuator 18 drives first array component 28A and second array component 28B with arm assembly 34. Arm assembly 34 includes linkage 36, which connects both first array component 28A and second array component 28B to actuator 18.

Figure 2:
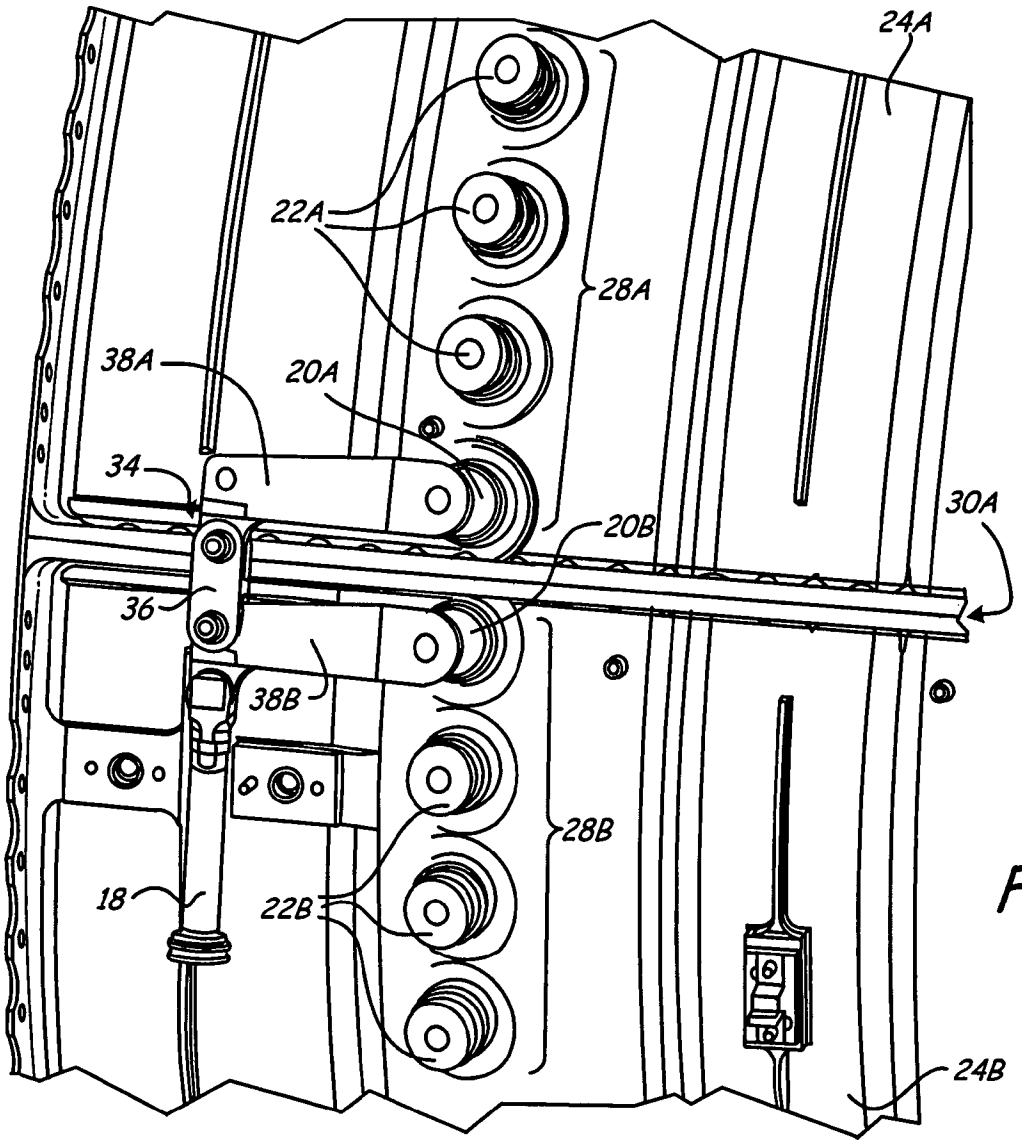
FIG. 2 shows a close up perspective view of the actuation mechanism of the present invention shown in FIG. 1B.

FIG. 2 shows a close up perspective view of arm assembly 34 shown in FIG. 1B. Arm assembly 34 comprises linkage 36, first arm 38A and second arm 38B. Linkage 36 can be disconnected from first arm 38A and or second arm 38B for uncoupling of first fan case 24A and second fan case 24B. First fan case portion 24A and second fan case portion 24B come together at seam line 30A.

First variable stator vane array 28A includes first stator vanes 22A that pivot within first fan case portion 24A at their outer diameter end. First stator vanes 22A are connected inside first vane shroud 24A by a synchronizing mechanism such that they all rotate in unison when any individual vane (e.g. drive vane 20A) is rotated. Second variable stator vane array 28B includes second stator vanes 22B that pivot within second fan case portion 24B at their outer diameter end. Second stator vanes 22B are connected inside second vane shroud 24B by a synchronizing mechanism such that they all rotate in unison when any individual vane (e.g. drive vane 20B) is rotated. First variable stator vane array 28A and second variable stator vane array 28B operate independently of each other. Examples of synchronizing mechanisms are described in the previously mentioned copending applications, which are incorporated by reference.

Actuator 18 is connected to a drive mechanism (not shown) that causes up and down motion (as shown in FIG. 2) of actuator 18. Second variable stator vane array 28B is connected to actuator 18 with second arm 38B. As actuator 18 is moved up or down by the drive mechanism, drive vane 20B is rotated correspondingly. Preferably, drive vane 20B is selected to be next to or near split line 30A. Second arm 38B provides a moment arm for rotating stator vane 20B. As a result of drive vane 20B being rotated, second follower vanes 22B are also rotated by the synchronizing mechanism inside second vane shroud 26B.

First variable stator vane array 28A is connected to first arm 38A through drive vane 20A. First arm 38A is connected to second arm 38B by linkage 36. As second arm 38B is rotated by actuator 18, linkage 36 rotates first arm 38A. First arm 38A provides a moment arm for rotating drive vane 20A. Preferably, drive vane 20A is selected to be next to or near split line 30A. As a result of drive vane 20A being rotated, follower vanes 22A also rotated by the synchronizing mechanism inside second vane shroud 26A. Thus, a single actuator, actuator 18, drives both first variable stator vane array 28A and second variable stator vane array 28B.

Figure 3:
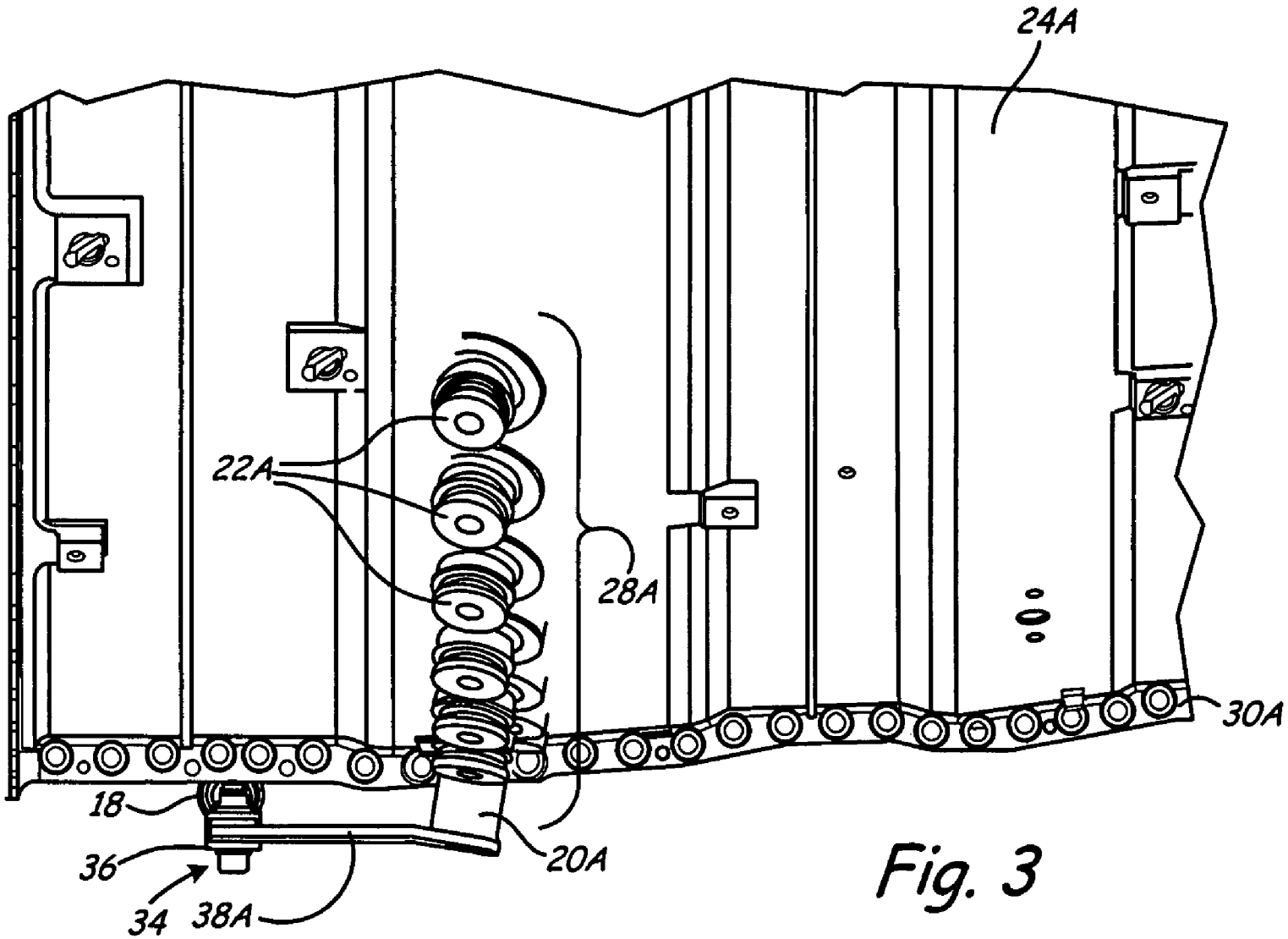
FIG. 3 shows a top view of the actuation mechanism of the present invention.

FIG. 3 shows a top view of arm assembly 34 of the present invention. First arm 38A is connected to the outer diameter end of drive vane 20A. First arm 38A is approximately parallel to first fan case portion 24A and approximately in the same plane as second arm 38B. The specific size and location of first arm 38A and lower arm 38B are dictated by the location of other external components of the gas turbine engine, including the drive mechanism of actuator 18, and the specific actuation requirements of the particular variable vane arrays.

Figure 4A:
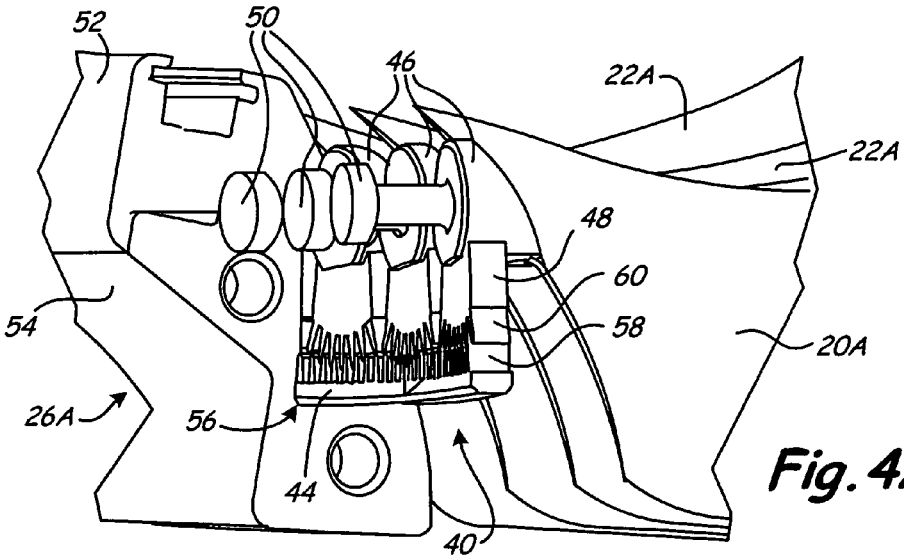
FIGS. 4A and 4B show a variable vane synchronizing mechanism comprising an inner diameter rack and pinion system.
Figure 4B:
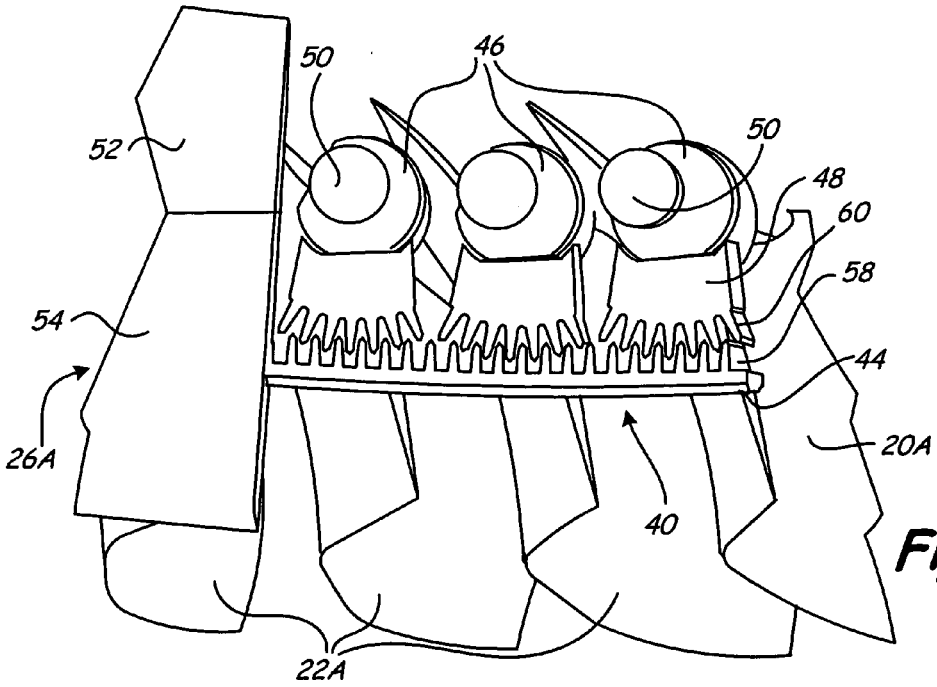

FIGS. 4A and 4B show perspective views of a variable vane synchronizing mechanism comprising inner diameter rack and pinion system 40, including inner diameter vane shroud component 26A, drive vane 20A, follower vanes 22A and gear rack 44. Drive vane 20A and follower vanes 22A include inner diameter trunnions 46, pinion gears 48 and buttons 50. Inner diameter vane shroud component 26A comprises forward vane shroud component 52, aft vane shroud component 54 and gear track 56. Gear rack 44, which includes rack gear teeth 58, is free to slide within gear track 56, which extends into the circumference of vane shroud 26A. Buttons 50 pivotably secure drive vane 20A and follower vanes 22A inside vane shroud component 26A. Pinion gears 48 include arcuate gear teeth segments 60, which are located on an aft facing portion of inner diameter trunnions 46 such that pinion gears 48 are insertable in gear track 56. Gear teeth segments 60 interface with rack gear teeth 58. Gear rack 44 rotates inside vane shroud component 26A within gear track 56, while pinion gears 48 pivot within gear track 56. Gear rack 44 synchronizes the rotation of follower vanes 22A when drive vane 20A is rotated by actuator 18. For example, if drive vane 20A is rotated clockwise (as shown in FIGS. 4A and 4B), gear rack 44 will be pushed to the left. Gear rack 44 will in-turn push pinion gears 48 to the left through rack gear teeth 58 and arcuate gear tooth segments 60. This causes follower vanes 22A of stator vane away 16 to likewise rotate in a clockwise direction. Thus, the direction of the flow of air exiting stator vane section 10 can be controlled for entry into the next section of the gas turbine engine utilizing the rack and pinion variable vane synchronizing mechanism.

Figure 5A:
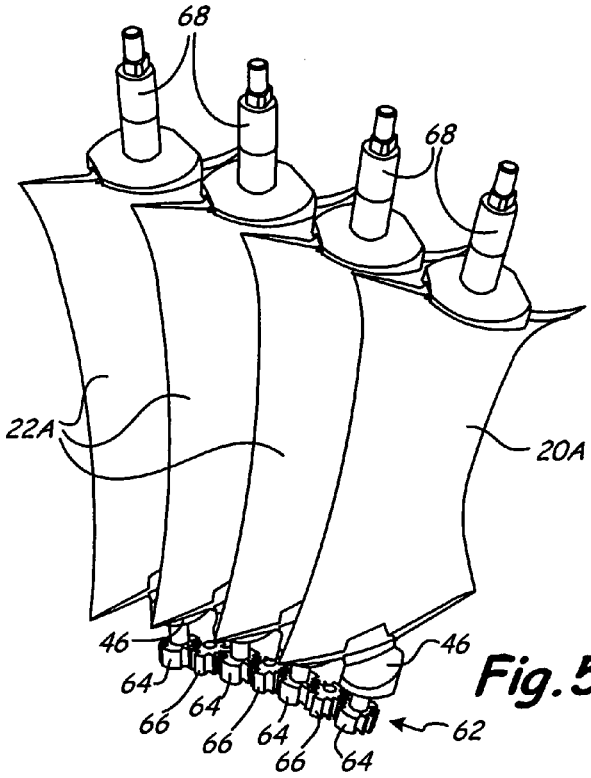
FIGS. 5A and 5B show a variable vane synchronizing mechanism comprising an inner diameter gear train system.
Figure 5B:
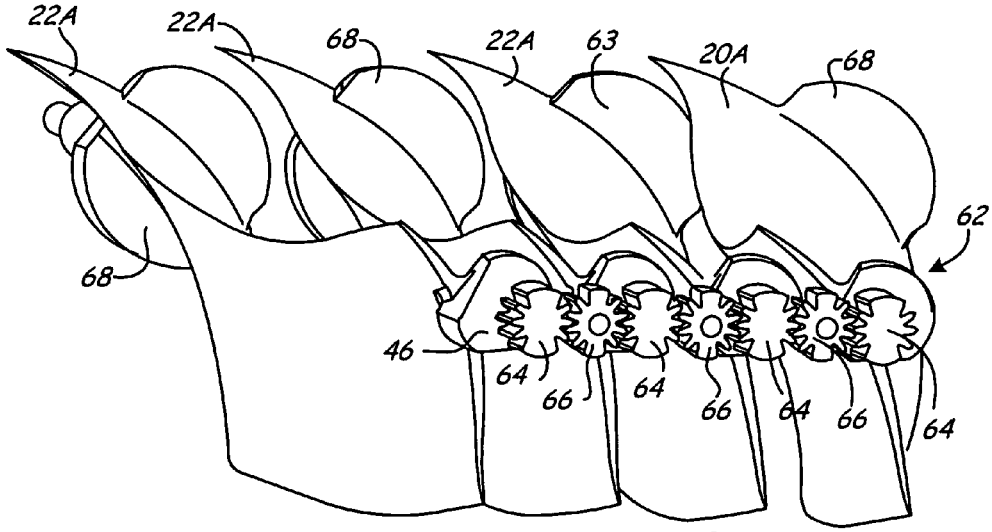

FIGS. 5A and 5B show perspective views of a variable vane synchronizing mechanism comprising inner diameter rack and pinion system 62, in which drive vane 20A and follower vanes 22A include vane gears 64 and idler gears 66. Drive vane 20A and follower vanes 22A also include outer diameter trunnions 68 for rotating in bosses within fan case component 24A, and inner diameter trunnions 46 for rotating in sockets within inner diameter vane shroud component 26A. Drive vane 20A is connected to actuator 18 outside of fan case component 24A, while drive vane 20A and follower vanes 22A are connected to rack and pinion system 62 within shroud component 26A. Vane gears 64 and idler gears 66 form a simple gear train shaped in an arcuate segment, such as approximately half circle (i.e. 180 ), within shroud component 26A for use in split shroud designs. When trunnion 68 of drive vane 20A is rotated by actuator 18, the rotation of follower vanes 22A is coordinated with the gear train synchronizing mechanism. For example, if drive vane 20A is rotated in a clock-wise direction (as shown in FIG. 5B) by actuator 18, all vane gears 64 are also rotated in a clock-wise direction, while all idler gears 66 are rotated in a counter-clock-wise direction. This same type of alternating rotation of vane gears and idler gears continues throughout the length of the gear train. Thus, actuation of only drive vane 20A rotates all of follower vanes 22A an equal amount.

Figure 6:
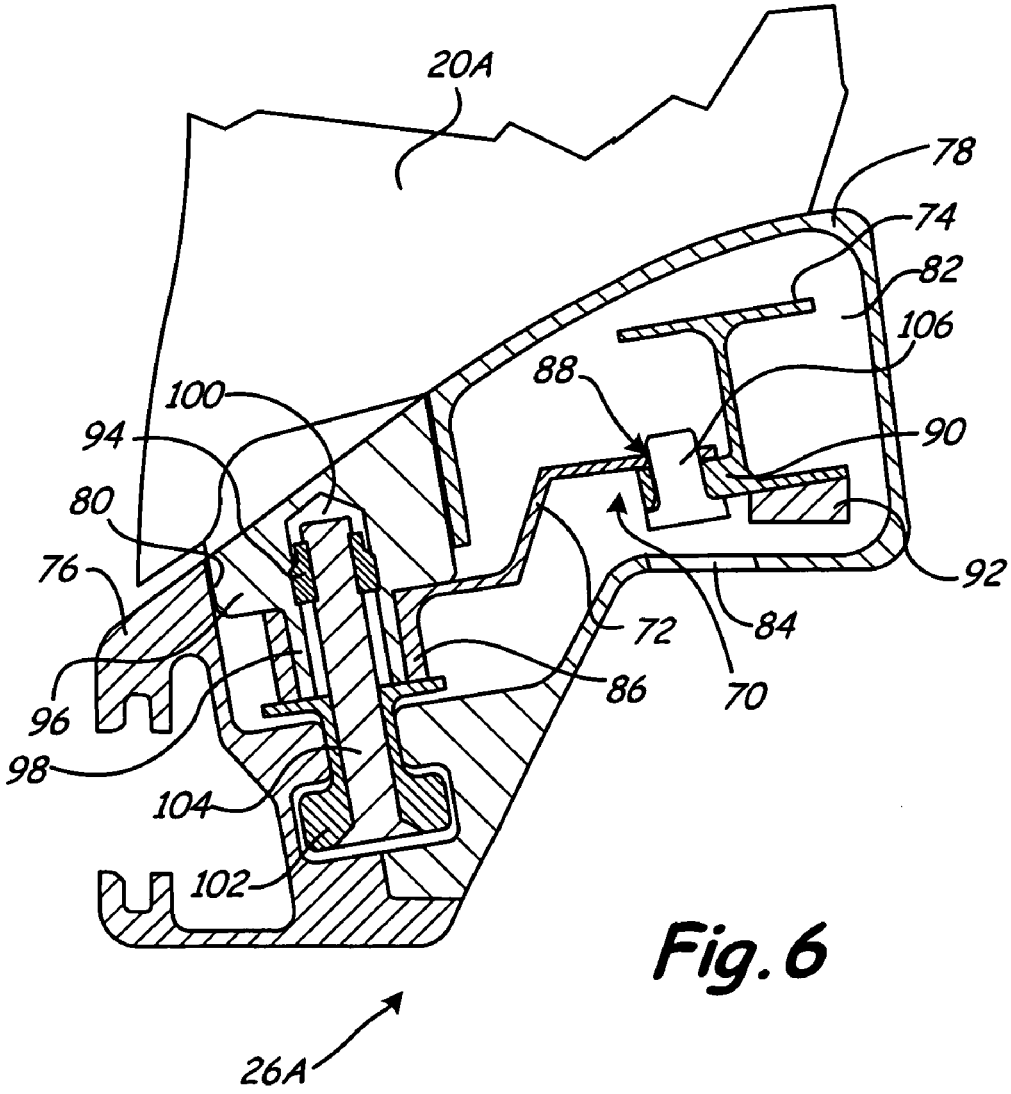
FIG. 6 shows a variable vane synchronizing mechanism comprising an inner diameter synch ring system.

FIG. 6 shows a cross section of a variable vane synchronizing mechanism comprising inner diameter synch ring system 70, including drive vane 20A, inner diameter vane shroud component 26A, vane arm 72, synch ring 74. Inner diameter vane shroud component 26A includes forward shroud component 76, aft shroud component 78, socket 80, inner channel 82 and clearance hole 84. Vane arm 72 includes trunnion hoop 86 and pin hole 88. Synch ring 74 includes lug 90 and bumper 92. Drive vane 20A includes locking insert 94, trunnion 96, vane arm post 98 and fastener channel 100. Locking insert 94 is secured inside of fastener channel 100. Trunnion hoop 86 of vane arm 72 is inserted over vane arm post 98. Button 102 is secured around the head of fastener 104. Fastener 104 is then inserted into fastener channel 100 and threaded into locking insert 94. Button 102 forces trunnion hoop 86 against trunnion 96 and secures it around vane arm post 98. Bumper 92 is positioned on a lower surface of synch ring 74 to assist synch ring 74 in maintaining a circular path through inner channel 82. Synch ring 74 is positioned inside of aft shroud component 78 within channel 82. Aft shroud component 78, along with synch ring 74, is then positioned against trunnions 96. Pin 106 is positioned through clearance hole 84, and into pin hole 88, securely fastening vane arm 72 to lug 90. Pin 106 is tight fitting in lug 90 and vane arm 72 is allowed to pivot at pin 106. The plurality of follower vanes 22A are linked to synch ring 74 in similar fashion. Forward shroud component 76 is positioned against aft shroud component 78 such that socket 80 fits around button 102. Button 102 is used to pivotably secure drive vane 20A inside socket 80. Forward shroud component 76 is fastened to aft shroud component 78 as is known in the art. During operation of synch ring variable vane synchronizing mechanism, actuator 18 rotates drive vane 20A, and follower vanes 22A are likewise rotated by other vane arms 72 about trunnions 96. Synch ring 74 is pushed by vane arm 72 of drive vane 20A and rotates inside inner channel 82. Synch ring 74 thereby pulls vane arms 72 connected to follower vanes 22A, which in turn rotates follower vanes 22A the same amount that drive vane 20A is rotated by actuator 18.

Although the present invention has been described with reference to preferred embodiments, workers skilled in the art will recognize that changes may be made in form and detail without departing from the spirit and scope of the invention.

The invention claimed is:

1. A variable stator vane actuation system for use in a turbine engine having a first fan case having a first array of variable vanes and second fan case having a second array of variable vanes, the actuation system comprising:

an inner diameter shroud for encasing an inner diameter synchronizing mechanism and receiving inner diameter ends of the first and second arrays of variable vanes;

a first drive vane arm for supplying a rotational force to a first drive vane of the first array of variable vanes;

a second drive vane arm for supplying a rotational force to a second drive vane of the second array of variable vanes; and a linkage for connecting the first drive vane arm and the second drive vane arm to coordinate rotation of the first and second arrays of variable vanes.

2. The actuation system of claim 1 wherein the first drive vane arm and the second drive vane arm comprise:

a first end adapted for connection to an outer diameter end of a variable vane; and a second end adapted for connection to the linkage and an actuation source.

3. The actuation system of claim 1 wherein the first fan case and second fan case are joined at split lines.

4. The actuation system of claim 3 wherein the first drive vane is located next to a split line of the first fan case.

5. The variable stator vane actuation system of claim of claim 3 wherein the first drive vane arm and the second drive vane arm are connected to outer diameter ends of the first drive vane and the second drive vane, respectively, and the linkage spans a split line.

6. The variable stator vane actuation system of claim 5 and further comprising:

a plurality of first follower vanes connected at their inner diameter ends to the first drive vane by the inner diameter synchronizing mechanism; and a plurality of second follower vanes connected at their inner diameter ends to the second drive vane by the inner diameter synchronizing mechanism.

7. The actuation system of claim 1 wherein the linkage is removable from the first drive vane arm and the second drive vane arm.

8. The variable stator vane actuation system of claim 1 and further comprising:

a first inner diameter synchronizing mechanism positioned within the inner diameter shroud for coordinating rotation of the first away of variable vanes; and a second inner diameter synchronizing mechanism positioned within the inner diameter shroud for coordinating rotation of the second array of variable vanes.

9. The variable stator vane actuation system of claim 8 wherein the first and second inner diameter synchronizing mechanisms comprise geared synchronizing mechanisms.

10. The variable stator vane actuation system of claim 8 wherein the first and second inner diameter synchronizing mechanisms include an inner diameter synch ring.

11. A variable stator vane section for use in a turbine engine, the stator vane section comprising:

a first assembly comprising:

a first fan case;

a first inner diameter vane shroud;

a first drive vane rotatably positioned between the first fan case and the first inner diameter vane shroud;

a first array of follower vanes rotatably positioned between the first fan case and the first inner diameter vane shroud;

a first inner diameter synchronizing mechanism positioned within the first inner diameter vane shroud for coordinating rotation of the first array of follower vanes; and a first drive vane arm for rotating the first drive vane;

a second assembly comprising:

a second fan case;

a second inner diameter vane shroud;

a second drive vane rotatably positioned between the second fan case and the second inner diameter vane shroud;

a second array of follower vanes rotatably positioned between the second fan case and the second inner diameter vane shroud;

a second inner diameter synchronizing mechanism positioned within the second inner diameter vane shroud for coordinating rotation of the second away of follower vanes; and a second drive vane arm for rotating the second drive vane;

an actuator; and a linkage for connecting the first drive vane arm and the second drive vane arm such that when one drive vane arm is rotated an amount by the actuator, the other drive vane arm is rotated a like amount, thereby coordinating the rotation of both the first and second variable vane arrays.

12. The stator vane section of claim 11 wherein the first drive vane arm and the second drive vane arm comprise:

a first end adapted for connection to a drive vane; and a second end adapted for connection to the linkage and the actuator.

13. The stator vane section of claim 11 wherein the first fan case and second fan case are joined at split lines.

14. The stator vane section of claim 11 wherein the first drive vane is located next to a split line of the first fan case and the second drive vane is located next to a split line of the second fan case.

15. The stator vane section of claim 11 wherein the linkage is removable from the first drive vane arm and the second drive vane arm.

16. The variable stator vane section of claim 11 wherein the first and second inner diameter synchronizing mechanisms are selected from the group consisting of: geared synchronizing mechanisms and synch ring synchronizing mechanisms.

17. The variable stator vane section of claim 11 wherein the first away of follower vanes and the second array of follower vanes are not connected to crank arms at their outer diameter ends.

18. The variable stator vane actuation mechanism of claim 11 wherein the actuator is directly connected to at least one of the first and second drive vane arms.

19. A variable vane actuation mechanism for a split vane array, the actuation mechanism comprising:

first and second semi-circular vane casings assembled at outer diameter split lines to form an annular outer diameter casing;

first and second semi-circular vane shrouds assembled at inner diameter split lines to form an annular inner diameter shroud;

first and second arrays of follower vanes rotatably connected to the casing and the shroud;

first and second drive vanes rotatably connected to the casing and the shroud and positioned adjacent an outer and an inner diameter split line and a follower vane;

first and second synchronizing mechanisms disposed within the shroud and connected to the first and second arrays of follower vanes and the first and second drive vanes; and a linkage spanning an outer diameter split line to connect the first and second drive vanes to each other outside the casing.

* * * * *

UNITED STATES PATENT AND TRADEMARK OFFICE

CERTIFICATE OF CORRECTION

PATENT NO. : 7,690,889 B2
APPLICATION NO. : 11/185995
DATED : April 6, 2010
INVENTOR(S) : John A. Giaimo and John P. Tirone, III It is certified that error appears in the above-identified patent and that said Letters Patent is hereby corrected as shown below:

Col. 6, line 14,
delete "of claim", (1st occurrence)

Col. 6, line 34,
delete "away",
insert --array--

Col. 7, line 3,
delete "away",
insert --array--

Col. 8, line 4,
delete "away"
insert --array--

Signed and Sealed this
First Day of March, 2011

David J. Kappos

David J. Kappos
*Director of the United States Patent and Trademark Office*